United States Patent [19]

Barto et al.

[11] Patent Number: 4,833,622

[45] Date of Patent: May 23, 1989

[54] INTELLIGENT CHEMISTRY MANAGEMENT SYSTEM

[75] Inventors: Ronald J. Barto, West Hartford; Frank Gabrielli, So. Windsor; Nancy C. Mohn, Windsor, all of Conn.

[73] Assignee: Combustion Engineering, Inc., Windsor, Conn.

[21] Appl. No.: 925,936

[22] Filed: Nov. 3, 1986

[51] Int. Cl.[4] ..... G06F 15/46; G01N 1/16

[52] U.S. Cl. ..... 364/496; 73/61.2; 73/865.6; 364/509; 364/550; 422/62; 204/404

[58] Field of Search ..... 364/496, 497, 510, 550, 364/570, 494, 509, 556; 73/61.2, 865.6, 863.31; 324/71.1,65 CR; 204/1 T, 404; 122/379; 422/62

[56] References Cited

U.S. PATENT DOCUMENTS

| | | | |
|---|---|---|---|
| 3,141,324 | 7/1964 | Boies et al. | 73/61.2 |
| 3,800,288 | 3/1974 | Russell et al. | 364/200 |
| 3,918,469 | 11/1975 | Zamboni et al. | 122/379 |
| 4,181,882 | 1/1980 | Isaacs et al. | 324/71.1 |
| 4,403,293 | 9/1983 | Bradt et al. | 364/494 |
| 4,453,499 | 6/1984 | Palmer | 122/379 |
| 4,466,383 | 8/1984 | Klatt et al. | 122/379 |
| 4,488,939 | 12/1984 | Fu | 204/404 |
| 4,637,346 | 1/1987 | Draper et al. | 73/865.6 |
| 4,640,233 | 2/1987 | Draper et al. | 73/865.6 |
| 4,648,043 | 3/1987 | O'Leary | 364/510 |
| 4,651,087 | 3/1987 | Shirato et al. | 324/71.1 |
| 4,654,187 | 3/1987 | Fejes et al. | 73/61.2 |
| 4,658,365 | 4/1987 | Syrett et al. | 364/496 |
| 4,683,035 | 7/1987 | Hunt et al. | 204/404 |
| 4,709,664 | 12/1987 | Barto et al. | 122/379 |
| 4,713,772 | 12/1987 | Carlson | 364/509 |

FOREIGN PATENT DOCUMENTS

| | | | |
|---|---|---|---|
| 8203133 | 9/1982 | World Int. Prop. O. | 364/494 |

*Primary Examiner*—Parshotam S. Lall
*Assistant Examiner*—Kevin J. Teska
*Attorney, Agent, or Firm*—Arthur E. Fournier, Jr.

[57] ABSTRACT

A system (10) particularly suited for employment for purposes of effectuating the monitoring, diagnosing and controlling of the chemistry of the water and steam in a steam generator steam cycle (46). The subject system (10) is operative to monitor water and steam quality at a number of critical locations (70,72,74,76) in the steam generator steam cycle (46). Based on the information gathered through such monitoring of water and steam quality, the subject system (10) is designed to be operative to provide diagnoses of potential causes of upsets in the steam generator steam cycle chemistry and to suggest corrective actions as appropriate. Furthermore, historical data is also readily available from the subject system (10) which can be utilized for identifying trends and for assessing the operational chemistry of the steam generator steam cycle (46) both on a short-term basis and on a long-term basis.

5 Claims, 5 Drawing Sheets

INTELLIGENT CHEMISTRY MANAGEMENT SYSTEM

CROSS-REFERENCE TO RELATED APPLICATIONS

This application is hereby cross-referenced to the following two patent applications which were commonly filed herewith and which are commonly assigned: U.S. patent application Ser. No. 926,058, filed Nov. 3, 1986 entitled "Method For Determining The Existence Of Hideout", filed in the name of Ronald J. Barto, Stephen L. Goodstine and Frank Noto and which issued as U.S. Pat. No. 4,709,664 on Dec. 1, 1987; and U.S. patent application, Ser. No. 926,042, filed entitled "Method For Ascertaining Chemical Addition Requirements", filed in the names of Ronald J. Barto, Stephen L. Goodstine and Frank Noto.

BACKGROUND OF THE INVENTION

This invention relates to monitoring, diagnosing and controlling systems, and more specifically to a system for monitoring, diagnosing and controlling steam generator water chemistry.

It has long been a well-known fact in the industry that corrosion in utility steam generators is an area of significant concern to both the manufacturers and users of such equipment. To this end, billions of dollars are reportedly being spent annually in the power generation industry alone in an effort to alleviate problems which are alleged to be caused by corrosion. Significant strides have here-to-date been made in attempting to minimize and, in some cases, to eliminate the effects of corrosion. Yet, despite the millions of dollars which to date have been spent for research and development on new materials and on developing operating practices to deal with corrosion and its effects, there are areas in which there still exist a need for improvement.

Reputedly, as high as 50% of the forced outages that are experienced by fossil-fuel steam generators are estimated to be corrosion-related. Such forced outages of steam generators when translated into dollars and cents have costs associated therewith which are deemed to be of the magnitude of $500 million annually. The two major causes of steam generator forced outages, i.e., the two most vulnerable portions of the steam generator cycle, have been found to be the furnace waterwalls and the steam circuits, which represent approximately 40% and 30%, respectively, of the failures that result in the forced outage of a fossil-fired steam generator. Additionally, of the major turbine problems that are experienced at utility steam generating installations, it has been found that two-thirds of them are associated with long- term steam purity upsets. A primary cause of corrosion-induced problems in these units is related to the water and steam-side chemistry environments. Prime candidates for failure when chemistry upsets occur are both thin-walled and thick-walled components. By way of exemplification and not limitation, hydrogen and caustic damage are directly related to improper boilerwater pH control, while oxygen pitting and overheating, stemming from the deposition of corrosion products, result from the inability to control oxygen and/or pH. Per unit, forced outages resulting from these and other corrosion-related failures can be quite costly, ranging from $120,000 to $720,000 per day for a 500 MW unit. Lost generating time and subsequent purchase of power for resale frequently constitute the major portions of outage cost. Consequently, minimizing or eliminating these types of occurrences can have both short-term and long-term implications for reducing overall operating and maintenance expenses.

Economics have also played a role in the increasing emphasis which is being placed on corrosion mitigation. Namely, as a result of U.S. economic conditions over the past 5–7 years, the task of forecasting load growth and electricity demand has become fret with uncertainties. This has had the effect of placing utilities in the position of having to make difficult decisions insofar as concerns arriving at a choice between the purchase of new equipment and the refurbishment of used equipment. To this end, programs have been initiated, including but not limited to life extension studies, which have for their objective the identification of the existence of deficiencies both in terms of equipment and in terms of operating practices which if modified and/or updated would have the effect of restoring unit integrity and/or of enabling operations to be maintained for extended periods of time at an acceptable level. Also, government and industry organizations have instituted programs which are designed to be operative to aid in effectuating the assessment of steam generator integrity. Many of these programs are related directly to the prevention of corrosion. Furthermore, it is known that much of the funding which is being expended in order to accomplish the implementation of the recommendations that have been generated in the course of performing such programs is being spent on the replacement and/or refurbishing of corrosion-damaged components.

New and better ways are being sought to avoid past problems and to assure increased steam generator availability and reliability. To the extent that a steam generator's operating mode changes from base-loaded to cycling operation, this task of increasing steam generator availability and reliability becomes even more difficult. As such, unless increased emphasis is placed on the steam generator's cycle chemistry environment, it can almost be guaranteed that corrosion-induced problems will occur.

The responsibility for implementing appropriate water technology practices, which can best meet the operational chemistry requirements of a given steam generating installation, rest with the operator of the steam generator. In turn the steam generator operators strive to meet these requirements by establishing monitoring, interpretation, control and trending methods which will work within the particular environment that is found to be present at a given steam generating installation. The methods which are used in this regard by the steam generator operators generally are adapted from generic guidelines that have been established by the various suppliers of the equipment which is being utilized.

By way of exemplification and not limitation, it will be assumed for purposes of the discussion which follows that the type of application which is the focus of attention is that of a high pressure steam cycle of the sort that one associates with a utility-type steam generator. In such an application, since the major sections of the cycle are coupled together, the water chemistry parameters for each of the sections must be compatible. As an example, consider that the steam turbine manufacturer has set limits for constituents contained in the steam. These limits in turn function as constraints on boilerwater chemistry and also on feedwater chemistry when used as desuperheating spraywater. In addition, limits established for boilerwater chemistry function as another constraint on feedwater chemistry. It should thus be readily apparent that when contamination occurs such as from condenser leakage, the entire cycle is affected. Finally, startups and load changes are also known to cause perturbations in the operational chemistry requirements of the cycle.

Continuing, there are to be found in the prior art the results of studies that have been conducted heretofore which contain findings derived from an examination of the nature of the monitoring points that have been employed for purposes of effectuating water chemistry monitoring of a high pressure steam cycle of the sort that is associated with a utility-type steam generator as well as from an examination of the frequency with which samples are normally taken at each monitoring point. Such studies encompass samples which have for water chemistry monitoring purposes been taken from the condensate/feedwater system, from the boilerwater and from the steam. With respect to the examination of these samples, the parameters that have been analyzed include pH, specific and cation conductivity, oxygen, hydrazine, silica, sodium, phosphate, chloride, iron and copper. The findings of these studies further reveal that sampling frequency varies on the one hand from continuous monitoring to on the other hand grab samples taken on the order of four times a year.

A detailed list of guidelines for monitoring and controlling steam cycle water chemistry is known to be in the process of being compiled by one of the industry organizations. Once such guidelines have been finalized they will undoubtedly serve as an excellent reference for steam generator operators. That is, the steam generator operators will be able to utilize these guidelines for purposes of developing a plan that has been customized to meet the requirements of their particular steam generating facility. It is known that at present not many steam generating installations utilize the full complement of possible monitoring points that are available. In addition, it is known that not many steam generating installations take samples with the frequency that it is believed they should be. To this end, the present practice is to select for monitoring one or more key parameters which are perceived to be sensitive indicators of steam cycle contamination, and to effect the monitoring thereof through the use of strip chart recorders and alarms which are found located in the control room at the steam generating installation. Other information is collected on log sheets which are reviewed periodically in order to detect trends and/or to assist in the identification of problem areas. The information which is compiled from such sources can in turn then be utilized for purposes of determining what, if any, control actions need to be taken. The actual implementation of such control actions will be effected, depending on a consideration of factors such as system preferences and shift coverage, either by the operators or by the chemistry laboratory technicians. Normally, such control actions are based on written instructions and/or consultation with the chemist who is assigned to the steam generating facility in question. Unfortunately, however, the task of establishing proper control over steam cycle chemistry is becoming more difficult both as the impact of trace contamination on the equipment being employed in the steam cycle becomes clearer, and as improvements in analytical measurements permit the detection of sub-parts per billion concentrations of contaminants.

For purposes of accomplishing the monitoring function as well as for purposes of presenting the information derived from such monitoring, the trend in the case of steam cycle chemistry as in the case of many other things these days is toward computerization. Computerization as referred to herein is meant to refer to the use of mainframe as well as to the use of desk top computers. By using computers it is possible to gain rapid access to large amounts of chemistry data while at the same time permitting this data to be presented in an easy- to-understand format. On the other hand, the exercise of control, i.e., the implementation of the control actions that are deemed to be necessary, generally is accomplished in a manual fashion. There are known to exist in the prior art though, some systems in which the control required to be exercised over feedwater treatment chemistry, e.g., hydrazine and ammonia, is exercised by means of conventional automatic controllers. Of these prior art systems, however, none possesses any interpretative or diagnostic capability. Therefore, any interpretation or diagnosis of the information which is derived from a monitoring of the steam cycle chemistry must be done by personnel who are appropriately trained for this purpose.

From the foregoing discussion it can, therefore, be clearly seen that the chemistry personnel of a steam generating installation face a difficult task in having to first assimilate a large body of data and then in having to draw conclusions on a real-time basis from this large body of data. Further, it is a requirement of these chemistry personnel that they possess an understanding of long-term trends and system performance so that they are in a position to meaningfully interpret this large body of data. For purposes of controlling both the short term and the long-term mechanisms which can cause corrosion damage in a steam generating steam cycle, it is necessary that the factors enumerated above be considered. There has thus been evidenced in the prior art a need for a new and improved form of system which would be operative to assist the chemistry personnel at a steam generating installation in successfully managing the water chemistry of a steam generating steam cycle.

It is, therefore, an object of the present invention to provide a new and improved system which is suitable for use for purposes of accomplishing the management of the water chemistry of a steam generating steam cycle.

It is another object of the present invention to provide such a system wherein in accord with one aspect thereof the system is operative to enable the water chemistry of the steam generating steam cycle to be monitored therewith.

It is still another object of the present invention to provide such a system wherein for purposes of accomplishing the monitoring of the water chemistry of the steam generating steam cycle, water and steam quality are monitored at a number of critical locations in the steam cycle.

A further object of the present invention is to provide such a system wherein in accord with another aspect thereof the system is operative to enable the water chemistry of the steam generating steam cycle to be diagnosed therewith.

A still further object of the present invention is to provide such a system wherein the diagnosis of the water chemistry of the steam generating steam cycle that is made therewith consists of the diagnosis of potential causes of chemistry upsets in the steam cycle coupled with a suggestion, where appropriate, as to the corrective action that should be taken as a result of the occurrence of the chemistry upsets.

A yet still further object of the present invention is to provide such a system wherein in accord with yet another aspect thereof the system is operative to enable the water chemistry of the steam generating steam cycle to be controlled therewith.

Yet another object of the present invention is to provide such a system for accomplishing the management of the water chemistry of a steam generating steam cycle which is suited equally well to being integrated into a steam generating installation either at the time of the initial construction thereof or subsequent to the initial construction thereof as a retrofit thereto.

Yet still another object of the present invention is to provide such a system that is advantageously characterized by the relative ease both with which the installation of the system can be effected and in the manner in which the operation of the system is accomplished.

SUMMARY OF THE INVENTION

In accordance with the present invention there is provided a system that is designed to be employed for purposes of effectuating the monitoring, diagnosing and controlling of the water chemistry of a steam generating steam cycle. More specifically, a system has been provided which is designed to be used by the personnel at a steam generating installation for purposes of assisting them as they attempt to successfully manage steam cycle water chemistry and which is characterized in that the system combines automated monitoring, diagnosing and controlling capabilities in the same system. The subject system uses data from continuous analyzers and process instrumentation to monitor the status of the steam generator water chemistry. In this regard, a minimum of four water and steam samples are required to obtain the needed information. Insofar as the diagnostic capability of the subject system is concerned, the purpose thereof is to supply the unit operators, system chemists and plant engineers with meaningful and useful information concerning feedwater, boilerwater and steam chemistry. The subject system also addresses interactions among the aforementioned three areas. In addition, the subject system is designed so that advisory intelligence is stated in easily understood language containing points of interest which will aid the recipient thereof in assessing a given situation. In accord with the preferred embodiment thereof, the subject system is designed such that through the operation thereof continuous monitoring as well as automatic control can be had therewith of both the feedwater chemistry and the boilerwater chemistry. Insofar as the matter of diagnostics is concerned, feedwater chemistry diagnostics begin with a determination of abnormal conditions wherein alarms are operated as appropriate for each monitored parameter to alert personnel of the fault conditions. Boilerwater chemistry diagnostics on the other hand are based on use of coordinated or congruent phosphate treatment, although it is to be understood that other forms of treatment such as all volatile, etc. could also be utilized without departing from the essence of the present invention. As regards steam chemistry, the diagnostics therefor as well as the automatic control thereof is effected through the exercise of control over feedwater chemistry and boilerwater chemistry. Thus, it can readily be seen through the installation of the appropriate hardware, the diagnostic capabilities of the subject system discussed hereinabove are employed for purposes of accomplishing the automatic adjustment of chemical feed pumps and valves, as required based on the diagnostic function performed by the subject system, so that steam cycle water chemistry will be properly maintained.

DESCRIPTION OF A PREFERRED EMBODIMENT

Figure 1:
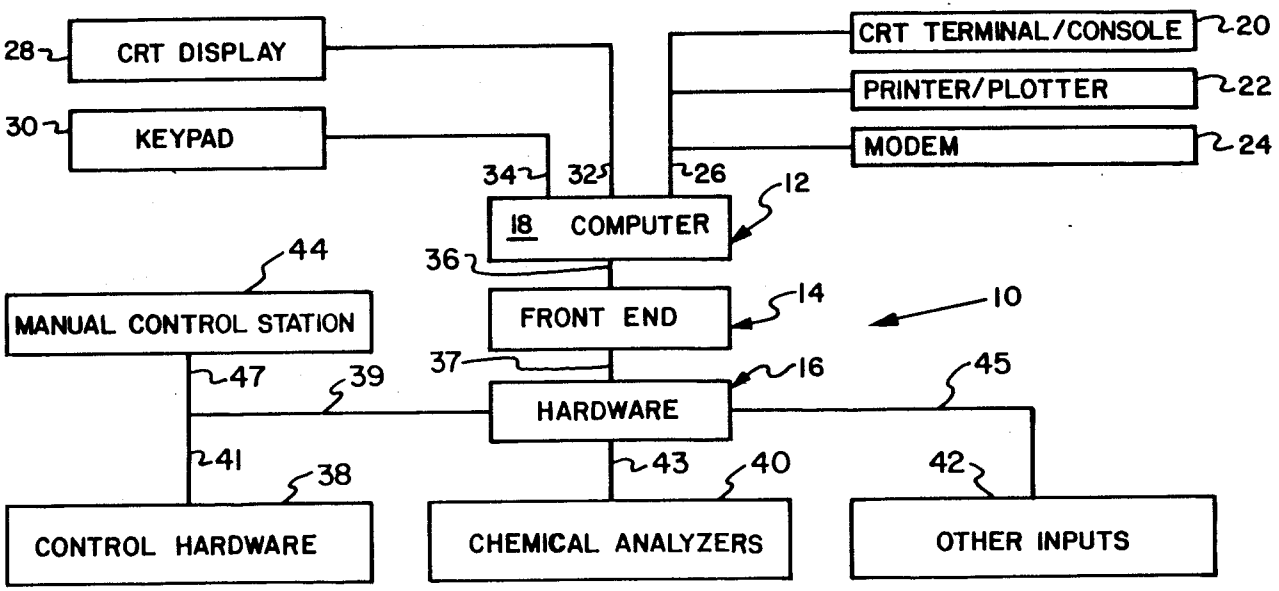
FIG. 1 is a schematic representation of the configuration of a steam generator steam cycle chemistry monitoring, diagnosing and controlling system constructed in accordance with the present invention.

Referring now to the drawing, and more particularly to FIG. 1 thereof, there is schematically illustrated therein a system, generally designated by the reference numeral 10, operative for monitoring, diagnosing and controlling the chemistry of a steam generator steam cycle, i.e., a steam generator steam cycle chemistry monitoring, diagnosing and controlling system, constructed in accordance with the present invention. As seen with reference to FIG. 1, the system 10 in accordance with the best mode embodiment of the invention is comprised of a number of major components. More specifically, the system 10 includes computer means, denoted generally by the reference numeral 12 in FIG. 1; front end means, denoted generally by the reference numeral 14 in FIG. 1; and hardware means, denoted generally by the reference numeral 16 in FIG. 1.

Considering first the computer means 12, the latter in accord with the illustrated embodiment of the invention includes a first portion which is designed to be located preferably in proximity to the location of the chemistry laboratory at the steam generator plant, and a second portion which is designed to be located preferably within the control room at the steam generator plant. The first portion of the computer means 12 encompasses a computer seen at 18 in FIG. 1, a CRT terminal/console seen at 20 in FIG. 1, a printer/plotter seen at 22 in FIG. 1 and also preferably a modem seen at 24 in FIG. 1. A computer that has been found to be suitable for employment as the computer 18 in the steam generator steam cycle chemistry monitoring, diagnosing and controlling system 10 is the MicroVax computer with color graphics display and printer which is manufactured and sold by Digital Equipment Corporation. It is to be understood, however, that computers manufactured by companies other than Digital Equipment Corporation could also be utilized for the aforedescribed purpose without departing from the essence of the present invention. This computer is designed to be located in or near the chemistry laboratory at the steam generator plant. By virtue of placing the CRT terminal/console 20, the printer/plotter 22 and the modem 24 in close proximity to the chemistry laboratory the computer 18 is readily accessible to the personnel working in the chemistry laboratory who have a need to make use thereof. In known fashion, the CRT terminal/console 20, printer/plotter 22 and modem 24 are all interconnected to the computer 18 through the use of suitable wiring, the latter being denoted in FIG. 1 by the reference numeral 26.

The second portion of the computer means 12 encompasses a CRT display shown at 28 in FIG. 1 and a function keypad shown at 30 in FIG. 1. The CRT display 28 and function keypad 30 are also interconnected to the computer 18. The interconnection of the CRT display 28 and function keypad 30 to the computer 18 is effected through the use of any suitable conventional means such as the wiring denoted by the reference numerals 32 and 34, respectively, in FIG. 1. For reasons that will become more fully apparent from the discussion that follows hereinafter, the placement in the control room at the steam generator plant of the CRT display 28, which preferably is designed to be panel-mounted, and the function keypad 30, which is designed to be operative for purposes of selecting displays, enables personnel in the control room to access the computer 18 for purposes of entering information thereto or for obtaining information therefrom pertaining to the chemistry of the steam generator steam cycle.

Turning next to a consideration of the front end means 14, the latter in accord with the best mode embodiment of the invention comprises an intelligent analog and digital input/output front end that is designed to be operative for data acquisition and control purposes. Any conventional form of front end that is available commercially and which is capable of being employed for the aforedescribed purpose may be selected for use as the front end means 14 in the steam generator steam cycle chemistry monitoring, diagnosing and controlling system 10. The front end means 14, like the computer 18, preferably is also located in or near the chemistry laboratory at the steam generator plant. In known fashion, the front end means 14 is interconnected to the computer 18 through the use of suitable wiring, the latter being depicted schematically in FIG. 1 wherein the wiring can be found denoted by the reference numeral 36.

There remains to be discussed herein one major component of the steam generator steam cycle chemistry monitoring, diagnosing and controlling system 10. This is the hardware means 16 which as shown schematically in FIG. 1 at 37 is operatively connected in known fashion to the front end means 14. For purposes of this discussion, the hardware means 16 is to be understood as encompassing all of the hardware which is employed in the steam generator steam cycle chemistry monitoring, diagnosing and controlling system 10 for monitoring and controlling purposes, i.e., the hardware that is employed for monitoring and effecting control of the status and flow of additive and blowdown streams. More specifically, included in this hardware are chemical additive feed tanks, pumps, pump/positioners and indicators, etc., as well as the hardware that is needed for purposes of accomplishing the automatic control of automatic blowdown. As will become more readily apparent from the discussion that follows hereinafter, in accord with the mode of operation of the steam generator steam cycle chemistry monitoring, diagnosing and controlling system 10 virtually all of the hardware which the hardware means 16 encompasses is designed to be located within the environs of the plant itself.

Continuing with the discussion of the hardware means 16, for ease of reference and as has been illustrated schematically in FIG. 1 by means of the lines of interconnection denoted therein by the reference numerals 39, 41, 43, 45 and 47, the hardware means 16 may be perceived as being composed of essentially four elements; namely, control hardware shown in FIG. 1 schematically at 38, chemical analyzers shown in FIG. 1 schematically as 40, other inputs shown in FIG. 1 schematically at 42 and a manual control station shown in FIG. 1 schematically at 44. In accord with the best mode embodiment of the invention the control hardware 38 consists of five additive feed set-ups that include pump flow transmitters and ON/OFF status/-switches, stroke position transmitters, low-tank level switches, and blowdown valve position transmitters and positioners. The chemical analyzers 40 on the other hand in accord with the best mode embodiment of the invention encompass a total of ten instruments, eight different types of instruments and four sample sources. Other inputs 42 in accord with the best mode embodiment of the invention refers to feedwater flow and conditions, and blowdown flow and conditions. Finally, the manual control station 44 in accordance with the best mode embodiment of the invention takes the form of an auto/manual control station which unlike the other hardware elements which the hardware means 16 encompasses is designed to be panel-mounted within the control room at the steam generator plant and wherein the auto/manual control station is dedicated to controlling the additive feedpumps and blowdown valve. Insofar as the mode of operation of the steam generator steam cycle chemistry monitoring, diagnosing and controlling system 10 of the present invention is concerned, it is believed that an understanding thereof can best be obtained by discussing the mode of operation of the steam generator steam cycle chemistry monitoring, diagnosing and controlling system 10 in the context of the latter's application to a typical steam cycle. To this end, there is illustrated schematically in FIG. 2 of the drawing a typical high-pressure utility steam cycle, the latter being denoted therein generally by the reference numeral 46, with which the steam generator steam cycle chemistry monitoring, diagnosing and controlling system 10 constructed in accordance with the present invention is particularly suited to be utilized.

Figure 2:
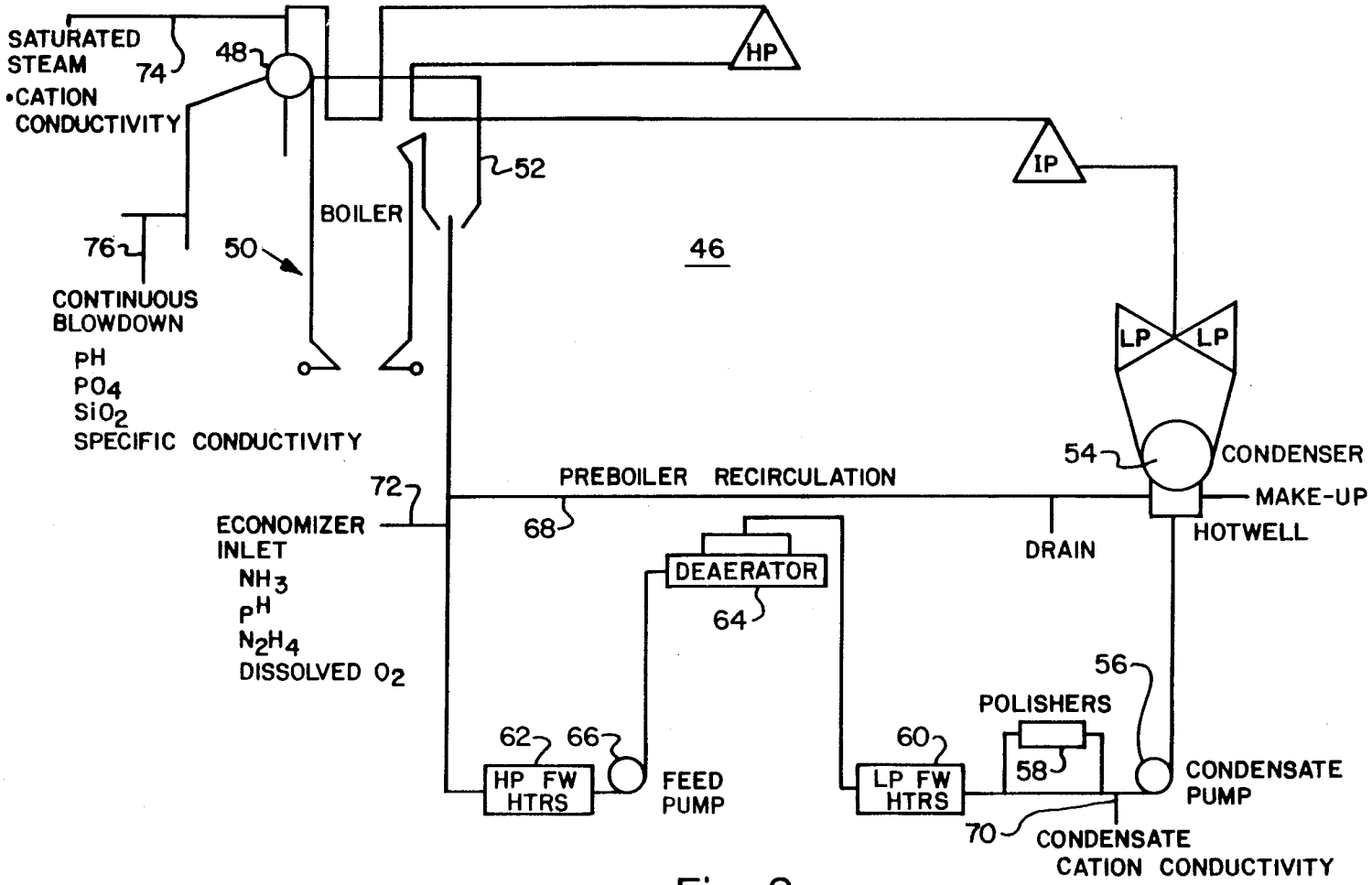
FIG. 2 is a schematic representation of the major components that are employed in a steam generator steam cycle depicting the nature of the samples utilized for purposes of the operation of a steam generator steam cycle chemistry monitoring, diagnosing and controlling system constructed in accordance with the present invention.

Inasmuch as the nature of the construction and the mode of operation of a high pressure utility steam cycle such as the high pressure utility steam cycle 46 which is illustrated schematically in FIG. 2 of the drawing is well-known to those skilled in the art, it is, therefore, not deemed to be necessary to set forth herein a detailed description of the high pressure utility steam cycle 46 shown in FIG. 2. Rather, it is deemed sufficient for purposes of acquiring an understanding of a high pressure utility steam cycle with which the steam generator steam cycle chemistry monitoring, diagnosing and controlling system 10 of the present invention is capable of being utilized that mention be had herein merely of those major components of the high pressure utility steam cycle 46 with which the steam generator steam cycle chemistry monitoring, diagnosing and controlling system 10 coacts. For a more detailed description of the nature of the construction and the mode of operation of the components of the high pressure utility steam cycle 46 reference may be had to the prior art.

Thus, referring again to FIG. 2 of the drawing, in accord with the illustration therein of the high pressure utility steam cycle 46 the major components thereof encompass a steam drum shown at 48, a boiler denoted generally by the reference numeral 50, an economizer identified by the reference numeral 52, a condenser illustrated at 54, a condensate pump seen at 56, polishers depicted at 58, low pressure feedwater heaters and high pressure feedwater heaters shown, respectively, at 60 and 62, a deaerator illustrated at 64 and a feedpump identified by the numeral 66. All of the components enumerated above that are encompassed in the high pressure utility steam cycle 46 as depicted in FIG. 2 of the drawing in a manner well-known to those skilled in the art are suitably interconnected in fluid flow relation one with another. In addition, as will be readily apparent from FIG. 2 an interconnection is had between the condenser 54 and the economizer 52 by means of the line schematically illustrated in FIG. 2 that bears the designation "PREBOILER RECIRCULATION" and that is denoted by the reference numeral 68.

In accord with a mode of operation thereof, the steam generator steam cycle chemistry monitoring, diagnosing and controlling system 10 makes use of data from continuous analyzers and process instrumentation for purposes of monitoring the status of the steam generator water chemistry. To this end, a minimum of four water and steam samples are required to obtain the needed information. The locations within the high pressure utility steam cycle 46 from whence these samples are obtained are illustrated in FIG. 2 of the drawing. Thus, as seen with reference to FIG. 2, one of these sample sources which is identified in FIG. 2 by the reference numeral 70, is located intermediate the condensate pump 56 and the polishers 58. Another sample source, the latter being denoted by the reference numeral 72 in FIG. 2, is located at the economizer inlet, i.e., at a point located between the high pressure feedwater heaters 62 and the economizer 52 and upstream of the preboiler recirculation line 68. The third and fourth sample sources, which are identified by the reference numerals 74 and 76, respectively, in FIG. 2 of the drawing, are located in proximity to the steam drum 48.

Insofar as concerns the nature of the specific samples that are required for purposes of the operation of the steam generator steam cycle chemistry monitoring, diagnosing and controlling system 10, the feedwater parameters of concern are pH, ammonia, hydrazine and dissolved oxygen. These are monitored at the economizer inlet, i.e., samples thereof are obtained from sample source 72. Condenser leakage is a major concern requiring cation conductivity measurement within the condensate. This measurement is obtained from sample source 70. Control of boilerwater chemistry using coordinated phosphate technique requires measurement of pH and phosphate. Specific conductivity for determination of solids concentration is also needed as is silica measurement. These species are analyzed from samples of the blowdown obtained from sample source 76. Cation conductivity in saturated steam from the steam drum 48 is also monitored by means of measurements obtained from sample source 74. In addition to the measurements enumerated above that are obtained from the sample sources 70,72,74 and 76 and which in turn are generated by the continuous analyzers illustrated schematically at 40 in FIG. 1 of the drawing, other inputs, to which reference has previously been had herein in connection with the discussion of the structure depicted in FIG. 1 of the drawing wherein these other inputs can found illustrated at 42, in the form of certain process parameters such as feedwater and blowdown temperature, and orifice pressure and differential pressure for flow calculations are also required to be provided to the steam generator steam cycle chemistry monitoring, diagnosing and controlling system 10 in connection with the operation thereof.

Figure 3:
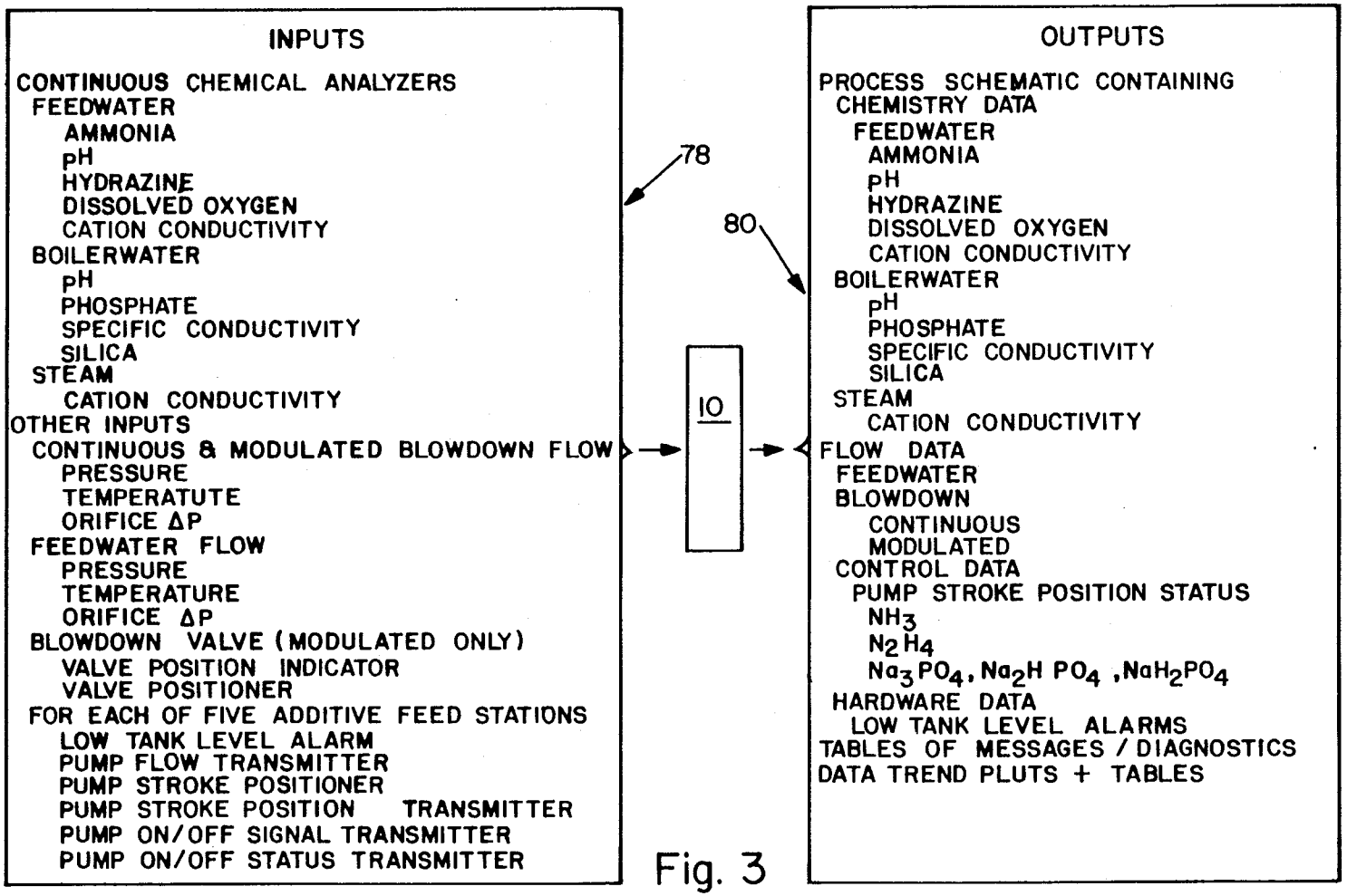
FIG. 3 is an illustration of the inputs and the outputs that are involved in the operation of a steam generator steam cycle chemistry monitoring, diagnosing and controlling system constructed in accordance with the present invention.

Depicted in FIG. 3 of the drawing is a summary of the minimum inputs, the latter being enumerated in the box that is denoted generally by the reference numeral 78 in FIG. 3, that are required to be provided in connection with the operation thereof to the steam generator steam cycle chemistry monitoring, diagnosing and controlling system 10. Also depicted in FIG. 3 of the drawing is a summary of the minimum outputs, the latter being enumerated in the box that is denoted generally by the reference numeral 80 in FIG. 3, that are generated by the steam generator steam cycle chemistry monitoring, diagnosing and controlling system 10 based on the reception by the latter of the inputs that are enumerated in the box depicted at 78 in FIG. 3 of the drawing. More specifically, with reference to the inputs enumerated in the box denoted by the reference numeral 78 in FIG. 3, those that appear below the heading "CONTINUOUS CHEMICAL ANALYZERS" are those that are derived based upon measurements obtained from the sample sources 70,72,74 and 76, while the inputs appearing under the heading "OTHER INPUTS" are those provided by the hardware illustrated schematically at 42 in FIG. 1 of the drawing. Finally, under the heading "FOR EACH OF FIVE ADDITIVE FEED STATIONS" appears the inputs that are provided by the hardware illustrated schematically at 38 in FIG. 1.

In addition to the monitoring function to which reference has been had hereinbefore, the steam generator steam cycle chemistry monitoring, diagnosing and controlling system 10 is further characterized by the fact that it also possesses the capability of being able to perform diagnostic and controlling functions. To this end, in accordance with the present invention the steam generator steam cycle chemistry monitoring, diagnosing and controlling system 10 is constructed so as to embody the capability of being able to execute, by way of exemplification and not limitation, such actions as retrieval of required data from the data base, determination of occurrence and severity of condenser leaks as well as sodium phosphate hideout, analysis of information to determine acceptability of the chemical environment and determination of corrective actions required to restore measured parameters to specified levels. As such, it can thus be seen that the steam generator steam cycle chemistry monitoring, diagnosing and controlling system 10 constructed in accordance with the present invention is designed to address all three of the areas involving water chemistry in a steam generator, i.e., feedwater, boilerwater and steam chemistry. On the other hand, however, note is taken here of the fact that the automatic control function which is capable of being performed by the steam generator steam cycle chemistry monitoring, diagnosing and controlling system 10 constructed in accordance with the present invention is based on feedwater and boilerwater information only. As noted previously herein, control of the steam chemistry parameters in accord with the preferred embodiment of the present invention is accomplished as a result of controlling feedwater chemistry and boilerwater chemistry. However, it is also to be understood that the steam chemistry parameters could, without departing from the essence of the present invention, be controlled independent of the control of feedwater chemistry and boilerwater chemistry.

Figure 4:
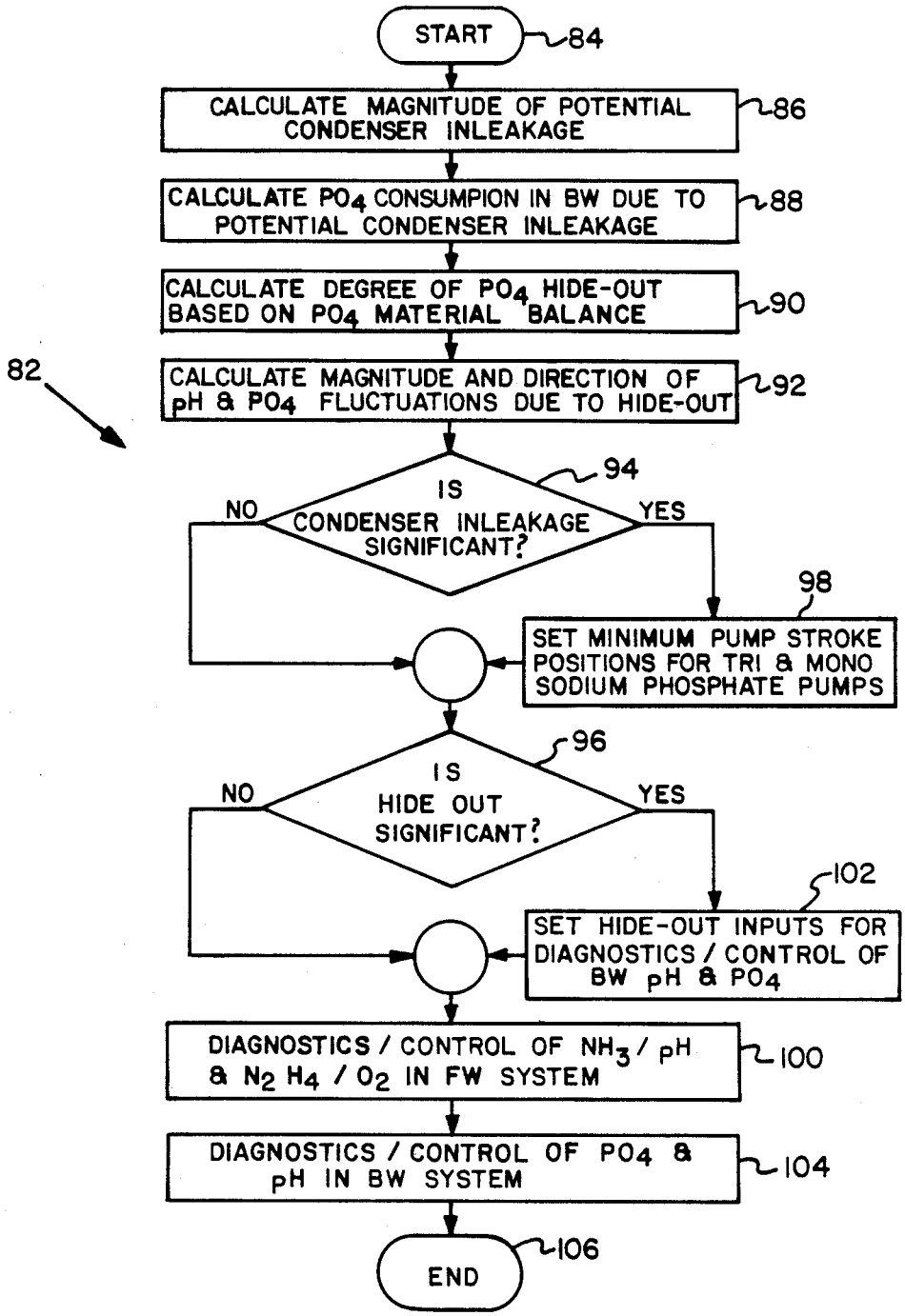
FIG. 4 is a flow chart illustrating the control logic employed in monitoring, diagnosing and controlling the chemistry of a steam generator steam cycle using a steam generator steam cycle chemistry monitoring, diagnosing and controlling system constructed in accordance with the present invention.

Continuing, reference will be had next to FIG. 4 of the drawing wherein there is to be found set forth an illustration of the control logic, generally designated therein by the reference numeral 82, which is employed for purposes of accomplishing the control function that the steam generator steam cycle chemistry monitoring, diagnosing and controlling system 10 constructed in accordance with the present invention is designed to perform. The control logic 82, as best understood with reference to FIG. 4 of the drawing, consists of a multiplicity of specific steps that are designed to be performed in accord with a preestablished sequence. To this end, the first step in the control logic 82 is that which is identified in FIG. 4 by the reference numeral 84 and the legend "START". The second step in the control logic 82 is that which is identified in FIG. 4 by the reference numeral 86 and the legend "CALCULATE MAGNITUDE OF POTENTIAL CONDENSER INLEAKAGE". In accord with the second step 86, there is performed a calculation of the magnitude of potential condenser leakage. The third step in the control logic 82 is that which is identified in FIG. 4 by the reference numeral 88 and the legend "CALCULATE $PO_4$ CONSUMPTION IN BW DUE TO POTENTIAL CONDENSER INLEAKAGE". In accord with the third step 88 there is performed a calculation of $PO_4$ consumption in the boilerwater due to potential condenser inleakage. The fourth step in the control logic 82 is that which is identified in FIG. 4 by the reference numeral 90 and the legend "CALCULATE DEGREE OF $PO_4$ HIDE-OUT BASED ON $PO_4$ MATERIAL BALANCE". In accord with the fourth step 90 there is performed a calculation of $PO_4$ hide-out based on $PO_4$ material balance. The fifth step in the control logic 82 is that which is identified in FIG. 4 by the reference numeral 92 and the legend "CALCULATE MAGNITUDE AND DIRECTION OF pH & $PO_4$ FLUCTUATIONS DUE TO HIDE-OUT". In accord with the fifth step 92 there is performed a calculation of the magnitude and the direction of pH and $PO_4$ fluctuations that are due to hide-out. The sixth step in the control logic 82 is that which is identified in FIG. 4 by the reference numeral 94 and the legend "IS CONDENSER INLEAKAGE SIGNIFICANT?". In accord with the sixth step 94 a determination is had as to whether condenser inleakage is significant. If the answer is NO, then in accord with the control logic 82 progression is had from the sixth step 94 to the step that is identified in FIG. 4 by the reference numeral 96 and the legend "IS HIDE-OUT SIGNIFICANT?". On the other hand, if the answer produced from the performance of the sixth step 94 is YES, then in accord with the control logic 82 progression is had from the sixth step 94 to the step identified in FIG. 4 by the reference numeral 98 and the legend "SET MINIMUM PUMP STROKE POSITIONS FOR TRI & MONO SODIUM PHOSPHATE PUMPS". In accord with the step 98 the minimum pump stoke positions are set for the tri and mono sodium phosphate pumps. Thereafter, progression is had from step 98 to step 96. Regardless of how step 96 is reached, in accord with the control logic 82 when step 96 is reached a determination is had of whether hide-out is significant. If the answer is NO, then in accord with the control logic 82 progression is had to the step that is identified in FIG. 4 by the reference numeral 100 and the legend "DIAGNOSTICS/CONTROL OF $NH_3$/pH AND $N_2H_4/O_2$ IN FW SYSTEM". On the other hand, if the answer produced from the performance of the step 100 is YES, then in accord with the control logic 82 progression is had from the step 96 to the step identified in FIG. 4 by the reference numeral 102 and the legend "SET HIDE-OUT INPUTS FOR DIAGNOSTICS/CONTROL OF BW p & $PO_4$". In accord with the step 102 the hide-out inputs are set for the diagnostics/control of boilerwater pH and $PO_4$. Thereafter, progression is had from step 102 to step 100. Regardless of how step 100 is reached, in accord with the control logic 82 when the step 100 is reached diagnostics/control is had of the $NH_3$/pH and the $N_2H_4/O_2$ in the feedwater system. The penultimate step in the control logic 82 is that which is identified in FIG. 4 by the reference numeral 104 and the legend "DIAGNOSTICS/CONTROL OF $PO_4$ & pH IN BW SYSTEM". In accord with step 104, diagnostics/control is had of the $PO_4$ and the pH in the boilerwater system. The final step in accord with the control logic 82 is that which is identified in FIG. 4 by the reference numeral 106 and the legend "END".

To complete the description of the nature of the construction and the mode of operation of the steam generator steam cycle chemistry monitoring, diagnosing and controlling system 10 of the present invention, a description will now be set forth of the software system that the steam generator steam cycle chemistry monitoring, diagnosing and controlling system 10 embodies. Reference will be had for this purpose in particular to FIG. 5 of the drawing. As best understood with reference to FIG. 5, the software system, denoted generally in FIG. 5 by the reference numeral 108, which the steam generator steam cycle chemistry monitoring, diagnosing and controlling system 10 embodies is comprised of five functional units. For the purpose of synchronizing sequenced activities these units communicate back and forth via interprocess communication links, the latter being shown as solid lines in FIG. 5 wherein the solid lines are identified by the reference number 110. Additionally, the functional units of the software system 108 share common data requirements by the use of disk files. The access paths for these disk files are shown as dotted lines in FIG. 5 wherein the dotted lines are identified by the reference numeral 112. These disk files facilitate the transfer of large amounts of data from program to program. Also, the disk files accommodate the long-term permanent storage of data for trending and historical purposes.

Figure 5:
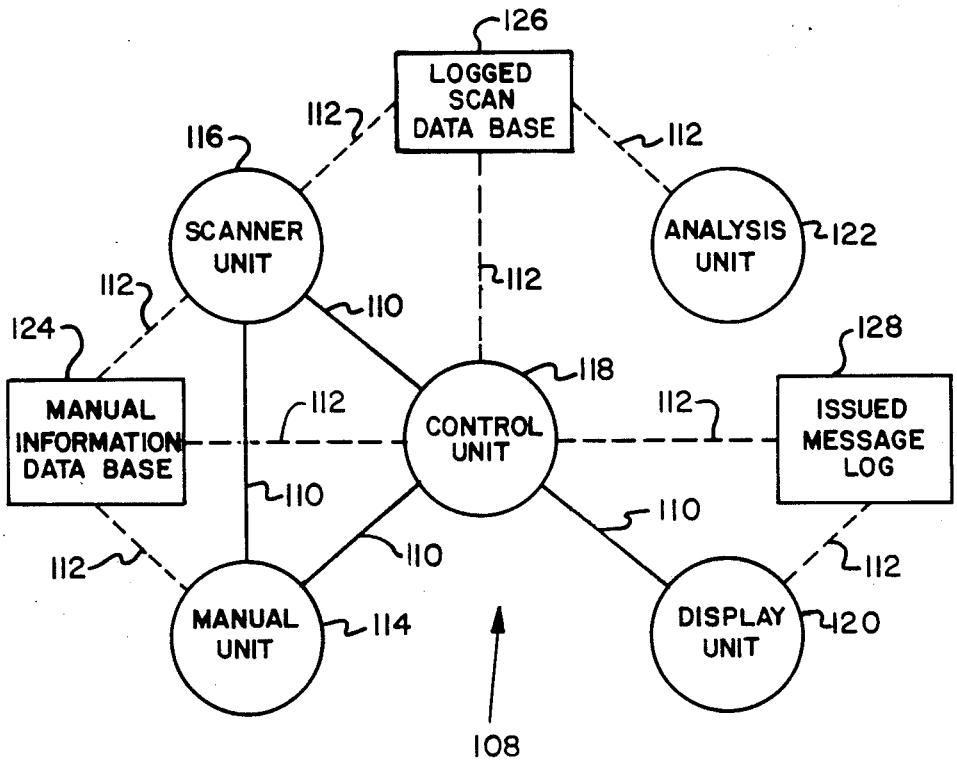
FIG. 5 is a schematic representation of the software system of a steam generator steam cycle monitoring, diagnosing and controlling system constructed in accordance with the present invention.

As depicted in FIG. 5 of the drawing, the five functional units that comprise the software system 108 are the manual unit seen at 114 in FIG. 5, the scanner unit seen at 116 in FIG. 5, the control unit seen at 118 in FIG. 5, the display unit seen at 120 in FIG. 5, and the analysis unit seen at 122 in FIG. 5. Considering first the manual unit 114, the latter comprises a menu driven interface program which is designed to support the operational set up of the steam generator steam cycle chemistry monitoring, diagnosing and controlling system 10 as well as serving as a means for altering tuning constants, system chemistry operating limits, instrument calibration data, etc. The manual unit 114 also permits the chemical analyses which have been obtained manually in the laboratory to be inputted into the steam generator steam cycle chemistry monitoring, diagnosing and controlling system 10. Furthermore, the manual unit 114 allows for complete flexibility in declaring which functions are to be automatically controlled. In this connection, by way of exemplification and not limitation, operators may elect to automatically control additive feed systems while using the steam generator steam cycle chemistry monitoring, diagnosing and controlling system 10 to provide diagnostic information for manual control of blowdown. All manual unit information is logged in the manual information data base seen at 124 in FIG. 5 and thereby becomes available to the other units of the software system 108.

Continuing, the scanner unit 116 is designed to be operative to direct the front end means 14 that is depicted in FIG. 1 insofar as concerns the performance by the latter of its assigned tasks. Typical of the instructions for the front end means 14 which are to be found contained in the scanner unit 116 are frequency of data scanning and determination of which parameters are to be scanned. Declaration of this information is accomplished by virtue of the interface which exists between the scanner unit 116 and the manual unit 114. The data which is acquired by the front end means 14, the latter being shown in FIG. 1, is designed to be stored in the logged scan data base which can be found depicted in FIG. 1 wherein the latter is identified by the reference numeral 126.

Focusing attention next on the control unit 118, the latter embodies the expertise that the steam generator steam cycle chemistry monitoring, diagnosing and controlling system 10 requires in order to perform the diagnostic and control functions to which reference has been had herein previously. The control unit 118 is designed to be operative to effectuate the execution of such actions as retrievable of required data from the data base, determination of occurrence and severity of condenser leaks as well as sodium phosphate hide-out, analysis of information to determine acceptability of the chemical environment, and determination of corrective actions required to restore measured parameters to specified levels. Any conditions that require message display result in an entry in the issued message log, which can be found depicted in FIG. 5 wherein the latter is identified by the reference number 128.

With regard to the display unit 120, the latter presents real-time data in engineering units of measure as calculated and communicated by the control unit 118 on a process schematic. Warning and diagnostic messages as contained in the message log 128 are also available for display. The operator has the ability to choose between the schematic or message display and can switch back and forth by depressing the appropriate key on the keypad (not shown) with which the display unit 120 in known fashion is suitably provided. The display unit 120 also possesses the capability of enabling past messages to be reviewed. The manner in which this is accomplished is by "backing up" through the message log 128.

The last of the functional units which collectively comprise the software system 108 that has yet to be discussed herein is the analysis unit 122. The analysis unit 122 enables access to be had to historical data as well as enabling tables and graphs to be prepared for purposes of establishing operational trends. The analysis unit 122 is characterized by the fact that a high degree of flexibility is offered thereby insofar as concerns the presentation of information in a simple and organized manner.

Thus, in accordance with the present invention there has been provided a new and improved system which is suitable for use for purposes of accomplishing the management of the water chemistry of a steam generator steam cycle. Moreover, the system of the present invention in accord with one aspect thereof is operative to enable the water chemistry of the steam generator steam cycle to be monitored therewith. In addition, in accord with the present invention a system is provided wherein for purposes of accomplishing the monitoring of the water chemistry of the steam generator steam cycle water and steam quality are monitored at a number of critical locations in the steam cycle. Further, the system of the present invention in accord with another aspect thereof is operative to enable the water chemistry of the steam generator steam cycle to be diagnosed therewith. Additionally, in accordance with the present invention a system is provided wherein the diagnosis of the water chemistry of the steam generator steam cycle that is made therewith consists of the diagnosis of potential causes of chemistry upsets in the steam cycle coupled with a suggestion, where appropriate, as to the corrective action that should be taken as a result of the occurrence of the chemistry upset. Also, the system of the present invention in accord with yet another aspect thereof is operative to enable the water chemistry of the steam generator steam cycle to be controlled therewith. Furthermore, in accordance with the present invention a system for accomplishing the management of the water chemistry of a steam generator steam cycle is provided which is suited equally well to being integrated into a steam generator installation either at the time of the initial construction thereof or subsequent to the initial construction thereof as a retrofit thereto. Finally, the system of the present invention is advantageously characterized by the relative ease both with which the installation of the system can be effected and in the manner in which the operation of the system is accomplished.

While only one embodiment of our invention has been shown and described herein, it will be appreciated that modifications thereof, some of which have been alluded to hereinabove, may still be readily made thereto by those skilled in the art. We, therefore, intend by the appended claims to cover the modifications alluded to herein as well as all other modifications which fall within the true spirit and scope of our invention.

What is claimed is:

1. A system for monitoring the chemistry of water and steam in a steam generator steam cycle to detect deviations thereof from specified levels, for diagnosing the need for corrections to be made in the chemistry of water and steam in the steam generator steam cycle, and for controlling the chemistry of water and steam in the steam generator steam cycle by implementing control corrections that are required to restore the chemistry of water and stem in the steam generator steam cycle to specified levels, comprising:

(a) monitoring means for monitoring the chemistry of water and steam at a plurality of preestablished locations in the steam generator steam cycle so as to detect deviations in the chemistry of water and steam from specified levels, said monitoring means generating signals in the form of data provided from process instrumentation and in the form of data provided from samples obtained by means of continuous analyzers positioned at preestablished locations in the steam generator steam cycle representative of the chemistry of water and steam being monitored by said monitoring means, said continuous analyzers being positioned at a minimum of four preestablished locations in the steam generator steam cycle, a first one of said continuous analyzers being positioned at a first location in the steam generator steam cycle so as to provide data pertaining to conductivity of the feedwater of the steam generator steam cycle, a second one of said continuous analyzers being positioned at a second location in the steam generator steam cycle so as to provide data pertaining to a presence of ammonia, pH, hydrazine and dissolved oxygen in the feedwater of the steam generator steam cycle, a third one of said continuous analyzers being positioned at a third location in the steam generator steam cycle so as to provide data pertaining to the presence of pH, phosphate and silica in boilerwater of the steam generator steam cycle as well as data pertaining to specific conductivity of boilerwater of the steam generator steam cycle, and a fourth one of said continuous analyzers being positioned at a fourth location in the steam generator steam cycle so as to provide data pertaining to cation conductivity of steam of the steam generator steam cycle;

(b) diagnosing means connected in circuit relation with said monitoring means for receiving signals from said monitoring means as an input to said diagnosing means, said diagnosing means having a preestablished bank of data stored therein pertaining to optimization of the chemistry of water and steam in a steam generator steam cycle, said diagnosing means in response to signals being received thereby from said monitoring means indicating deviations in the chemistry of water and steam in the steam generator steam cycle from specified levels establishing corrections that are required to be made in the chemistry of water and steam in the steam generator steam cycle to restore the chemistry of water and steam in the steam generator steam cycle to specified levels, said diagnosing means further when a need for such corrections in the chemistry of water and steam in the steam generator steam cycle is deemed to exist producing an output representative of the nature of corrections that are required to be made in the chemistry of water and steam in the steam generator steam cycle to restore the chemistry of water and steam to specified levels; and (c) control means connected in circuit relation with said diagnosing means for receiving said output therefrom, said control means having a preestablished bank of data stored therein pertaining to control of the chemistry of water and steam in a steam generator steam cycle, said control means upon receipt of said output from said diagnosing means establishing control corrections that are required to be made to the chemistry of water and steam in the steam generator steam cycle to restore the chemistry of water and steam to specified levels, said control means further effecting the implementation of control corrections that are required to be made to restore the chemistry of water and steam in the steam generator steam cycle to specified levels.

2. The system as set forth in claim 1 further including manual means connected in circuit relation with said diagnosing means and said control means, said manual means effecting a selective introduction of new constants into the system, said manual means further effecting a manual inputting of data into the system.

3. The system as set forth in claim 2 further including scanner means connected in circuit relation with said monitoring means, said scanner means determining frequency with which and nature of the monitoring performed by said monitoring means.

4. The system as set forth in claim 3 further including display means connected in circuit relation with said manual means, said display means selectively effecting a visual display of real-time data, diagnostic messages and warning messages.

5. The system as set forth in claim 4 further including analysis means connected in circuit relation with said display means, said analysis means effecting a visual display of graphs and tables reflecting operational trends in the chemistry of water and steam in the steam generator steam cycle.

* * * * *